US006626597B2

(12) United States Patent
Fujiwara

(10) Patent No.: US 6,626,597 B2
(45) Date of Patent: Sep. 30, 2003

(54) PRINTER ASSEMBLY AND PRINTER

(76) Inventor: Hitoshi Fujiwara, 1788-156, Ohaza Hirooka-nomura, Shiojiri-shi, Nagano 399-0702 (JP)

( * ) Notice: Subject to any disclaimer, the term of this patent is extended or adjusted under 35 U.S.C. 154(b) by 31 days.

(21) Appl. No.: 10/072,944

(22) Filed: Feb. 12, 2002

(65) Prior Publication Data

US 2002/0090241 A1 Jul. 11, 2002

Related U.S. Application Data

(63) Continuation-in-part of application No. 09/665,285, filed on Sep. 20, 2000, now abandoned.

(30) Foreign Application Priority Data

Sep. 21, 1999 (JP) ..... 11-267366

(51) Int. Cl.[7] ..... B41J 13/02; B41J 13/036; B41J 3/36

(52) U.S. Cl. ..... 400/659; 400/88; 347/220

(58) Field of Search ..... 400/648, 88, 659, 400/120.16; 347/215, 218, 220

(56) References Cited

U.S. PATENT DOCUMENTS 4,916,463 A * 4/1990 Tzeng et al. ..... 347/220

FOREIGN PATENT DOCUMENTS

| | | | | |
|---|---|---|---|---|
| JP | 57150586 A | | 9/1982 | |
| JP | 61290072 A | | 12/1986 | |
| JP | 05000537 A | * | 1/1993 | ..... B41J/11/20 |
| JP | 08187901 A | | 7/1996 | |

OTHER PUBLICATIONS

IBM Technical Disclosure bulletin, "Keyboard Printer With Paper Advance from Print Obscuring Position," Apr. 1, 1976, vol. 18, Issue 11, pp. 3765–3766, No. NN76043765.*
European Search Report, dated Mar. 21, 2001.
Form PTO–1449 submitted in Ser. No. 09/665,285 and considered by Examiner.
European Search Report.
Patent Abstracts of Japan, vol. 1996, No. 11, Nov. 29, 1996, JP 08 187901, Jul. 23, 1996.
Patent Abstracts of Japan, vol. 006, No. 256, Dec. 15, 1982, JP 57 150586, Sep. 17, 1982.
Patent Abstracts of Japan, vol. 011, No. 158, May 22, 1987, JP 61 290072, Dec. 20, 1986.

* cited by examiner

*Primary Examiner*—Dan Colilla

(57) ABSTRACT

A printer and a printer assembly of the present invention includes: a line thermal head; a platen roller having surface of high coefficient of friction for holding a printing paper between the platen roller and the line thermal head to feed the printing paper; supporting rollers having surface of low coefficient of friction, disposed at front and rear of the platen roller along a paper feeding direction so as to support the platen roller from a side opposed to the line thermal head; a supporting plate extending along the supporting rollers so as to receive the supporting rollers from a side opposed to the line thermal head; and pressurizing means for applying pressure between the supporting rollers and the line thermal head. The platen roller is supported along its longitudinal direction by the supporting rollers comprising a small member with low coefficient of friction. Accordingly, even when the diameter of a platen roller is small, it is possible to apply sufficient pressure on to the line thermal head, and thin and compact printer assembly and printer can be provided.

18 Claims, 5 Drawing Sheets

PRINTER ASSEMBLY AND PRINTER

CROSS-REFERENCE TO RELATED APPLICATION

This application is a Continuation-in-Part (CIP) of U.S. application Ser. No. 09/665,285 filed Sep. 20, 2000, now abandoned.

BACKGROUND OF THE INVENTION

1. Technical Field

The present invention relates to a printer assembly (printing assembly) and a printer for printing on a thermosensible (thermal) paper.

2. Description of the Related Art

In recent years, various types of computers have been developed and used that includes a portable type such as a notebook type and a portable or mobile type such as a PDA which can be put in a pocket. As the Internet becomes popular, applications of computers have been spread in various fields including information service and communication, and the population of users has also been spread from a specialist to a general user. Accordingly, computers will be daily used in ordinary homes in the future. In addition, the application handling daily works with a computer at home, by introducing computerized account settlement, electronic commerce.

According to increase of mobile computers and other mobile devices, user will require printout whenever they are required even if they are using mobile computer. However, in a case that computers are used for daily works such as electronic transaction, an amount of prints is not so many and the frequency of printing is also not so many. Accordingly, one style or aspect of a printer which is demanded in the future for the above mobile computer will surely be thin, compact, light-weight and low-cost type and it can be carried together with a portable information processing device and/or portable terminal such as a PDA, a portable telephone or the like, by being built in the device and/or being connected to the device.

A printer for printing on a thermosensible paper or thermal paper using a thermal head does not require ink or ribbons. Therefore, its printing mechanism becomes compact. Specifically, a line thermal printer having a line thermal head extending in a paper width direction (scanning direction or line direction) does not require a mechanism for moving a thermal head in the scanning direction. Hence the line thermal printer becomes much compact and the printer meets the above demand.

However, a mechanism for pressing a printing paper on a thermal head is an obstacle to realize a very thin printer having a thickness of, for example, about 10 mm or less. In the thermal printer, a mechanism for feeding a thermal paper or sheet has a platen roller. The platen roller presses the paper on the thermal head by holding the paper between the thermal head and feeds the thermal paper by rotating. In order to realize a thin printer having a thickness of 10 mm or less, a diameter of the platen roller shall be smaller than that of the conventional printer. When the diameter of the platen roller becomes small, a contacting area or surface between the roller and the printing paper is reduced, so that the platen roller must be pressed on the paper with stronger force in order to keep a sufficient contacting force for pressing the thermal paper to the thermal head. However, when the diameter of the platen roller becomes 10 mm or less, the roller lacks in strength. Therefore, when pressing force is increased for compensating for the lack of contacting area, flexure or bending tends to occur in the platen roller.

Particularly, when the diameter becomes 5 mm or less, flexure occurs over the entire length of the platen roller. Accordingly, when the platen roller is supported only at both ends, it becomes impossible to press the printing paper on the thermal head by the platen roller with sufficient force for printing. Particularly when the line thermal head is used and the force for pressing the thermal paper is deviated along the direction of the paper width, the pressing forces are lost in some portion of the paper. Therefore, printing quality deteriorates so that it becomes impossible to perform practical printing.

For preventing the platen roller from flexing, the platen roller may be divided along its longitudinal direction so that the shaft of roller is exposed and is supported by a bearing. However, for printing along the thermal head without missing of data, the pressure must be continuously applied by the platen roller along the scanning direction. Therefore, the platen roller cannot be divided along its longitudinal direction. It is also possible to support the entire platen roller from a side opposed to the thermal head by a member extending in the longitudinal direction. However, for feeding the paper smoothly, the surface of the platen roller is formed of material having a high coefficient of friction, such as a rubber. For this reason, in a pressed or pressurized state, a frictional force between such a supporting member and the platen roller is excessively large so that driving force of a motor for rotating the platen roller becomes too large and such a large capacity motor cannot be installed in thin and small printer.

It is also possible to install several sub rollers along the longitudinal direction of the platen roller to prevent the platen roller from flexing. However, if we applied the sub rollers supported by a shaft and bearings, it is necessary to make an additional space for arranging the sub rollers and their bearings including some clearances between the sub rollers and the housing of printer. Therefore, the above solution cannot be applied for the extremely thin printer of this invention.

Hence, an object of this invention is to solve the above problems about the platen rollers that are the neck of realizing a very thin printer and to provide a thin printer that can achieve a high printing quality. In addition, in the present invention, it is an object to provide a very thin printing mechanism or printer assembly and a very thin line thermal printer by the printer assembly that has a thickness about 10 mm or less, and further about 5 mm or less.

SUMMARY OF THE INVENTION

For achieving the object, in a printer assembly of the present invention, a platen roller is supported by thin rollers (shafts) of a small diameter having a surface of small or low coefficient of friction. In addition, a plate-shaped member supports or bears the supporting rollers so that flexure of the platen roller is prevented via the supporting plate and supporting rollers. Therefore, in this invention, if the diameter of the platen roller is small, stronger pressure or force can be applied between the platen roller and a thermal head. That is, the printer assembly of the invention comprises a line thermal head, a platen roller having a surface of high or large coefficient of friction, which holds a printing paper between the line thermal head and the platen roller and feeds the printing paper, supporting rollers having a surface of small or low coefficient of friction respectively, which are disposed at a front and a rear of the platen roller in a paper feeding direction so as to support the platen roller from a side opposed to the line thermal head, a supporting plate extending along the supporting rollers for supporting or bearing the supporting rollers from a side opposed to the line thermal head, and pressurizing or pressing means for applying pressure between the supporting rollers and the line thermal head.

The platen roller made of a metal member whose surface is processed for increasing a coefficient of friction or the platen roller made of a resin material with a high coefficient of friction such as phenol resin may be used, but the platen roller covered by the rubber materials having some elasticity and a high coefficient of friction is the most suitable. On the other hand, a member made of resin having a low coefficient of friction, for example, nylon, polyethylene or the like is suitable for the supporting rollers. A rod-shaped member made of fluororesins is the most suitable for the supporting rollers since it has so smaller coefficient of friction that becomes several tenths, or one or more digits smaller than that of rubber material.

In this printer assembly, the supporting rollers having a small coefficient of friction support the platen roller having a large coefficient of friction, and the supporting plate extending along the longitudinal directions of the supporting rollers bears the supporting rollers. Therefore, the supporting plate receives or bears the load of the platen roller continuously along the longitudinal direction of the platen roller via the supporting rollers. Accordingly, even when the platen roller itself is not high in rigidity, it is prevented from flexing and/or bending and applies high pressure on the paper along the width direction (the longitudinal direction of the roller) continuously.

In addition, the platen roller having a surface of high coefficient of friction rotates the supporting rollers having a surface of small coefficient of friction, and the supporting rollers touch and rotate on the supporting plate. Accordingly, frictional force against to the rotation of the platen roller becomes so small.

Furthermore, as the supporting rollers are directly supported or received by the supporting plate, it becomes unnecessary to separate the supporting rollers from a structure member of printer assembly for making a clearance. Therefore, the line thermal head, the platen roller and the supporting rollers can be disposed in a very thin space. Accordingly, in the printer assembly of this invention, the above components are assembled in a very thin space and the driving power for paper feeding becomes so small.

Also, in this printer assembly, the supporting rollers are provided at front and rear of the platen roller. Therefore, the supporting rollers fix the front and rear positions of the platen roller. Furthermore, by this arrangement of the platen roller and the supporting roller, the supporting rollers are not disposed along a line of the thermal head and the platen roller. Namely, a line connecting the center axis of the platen roller and the center axis of each supporting roller is inclined or not parallel to the line of the platen roller and the thermal head. Accordingly, the line thermal head, the platen roller and the supporting rollers are disposed triangular like arrangement in a thinner manner by absorbing or reducing space corresponding to the diameter of the supporting rollers.

For example, for printing a printing paper with a post card size (A6 size 105 mm×148 mm) or so, a printer assembly having a thickness of about 5 mm or less can be realized by combining a thermal head having the thickness of 2 mm, the platen roller having a diameter of 2 mm and supporting rollers having a diameter of 1 mm. Accordingly, by combining the printer assembly of this invention and a paper feeding mechanism for feeding thermal paper thereto, a compact printer that is very thin and portable can be provided. Therefore, the printer of this invention can be built into information processing device, and being suitable for use together with a portable terminal such as a portable telephone and a PDA, in a docking manner and/or built-in manner.

In the printer assembly, it is preferable that each of the supporting rollers rotates at predetermined position at front and rear of the platen roller. The supporting plate having a U shape inner portion can accommodate the supporting rollers respectively in front and rear corners of the U shape inner portion. Also, the supporting plate having grooves and/or recesses for fixing rotating positions of the supporting rollers can be applicable.

In the printer assembly of this invention, when a printing paper is a larger size, more torsional strength are required for the platen roller and therefore the platen roller having a diameter of about 10 mm is required. However, this printer assembly dose not require a platen roller having rigidity to the extent being not flexed as a conventional printer. Accordingly, a printer assembly and a printer having a thickness of ten-odd mm for printing an A4 size (210 mm×297 mm) sheet can be realized according to the present invention.

The object of the present invention is to provide such very thin printer assembly and printer, and it is preferable that the diameter of the platen roller is made as small as possible. Accordingly, it is difficult to provide rigidity to the platen roller so it is not flexed or to maintain the platen roller horizontally relative to the thermal head, as mentioned above. However, in the present invention, the platen roller becomes brought into close contact with the thermal head by the flexibility of the platen roller itself. Namely, since the platen roller and the supporting rollers are flexible, the platen roller can be brought into close contact flexibly with the thermal head even if the thermal head becomes flexible, which is different from a conventional structure. When the entire structure of the printer assembly is made thin, it becomes difficult to reinforce the line thermal head as rigid enough. Therefore, when a thin thermal head is employed, the thermal head itself may be flexed due to pressure. Even in this case, in the printer assembly of the present invention, the platen roller can be brought into close contact with the thermal head. Therefore, this invention provides a thin and reliable printer assembly capable of performing a high quality printing. In addition, as mentioned above, for feeding the sheet or paper reliably in the thin space, combination of the platen roller having a flexible shaft coated or covered with rubber, and the supporting rollers having flexible shafts with low coefficient of friction surface is suitable.

In the printer assembly of the present invention, the platen roller is supported substantially continuously along longitudinal direction via the supporting rollers that extend along the platen roller. Therefore, the platen roller touches continuously, without deformation, to the line thermal head so as to make uniformity print. If the supporting rollers are not continuously extended along the platen roller, surface of the platen roller deforms due to discontinuous pressure from the supporting roller.

In the present printer assembly, pressure for pressing the platen roller to the head can be applied from an upward and/or a downward, namely from the direction of the line thermal head and/or the direction of the supporting plate. It is possible to dispose the pressurizing means between the supporting rollers and the supporting plate. In this case, it is preferable to use thin pressurizing means such as arch-type leaf spring(s). When the supporting rollers touch with the pressurizing means, the supporting rollers rotate can be rotated by low power due to their low friction coefficient.

It is also possible to apply pressure on the platen roller via the supporting plate by the pressurizing means such as a member or members of high elasticity such as springs or rubbers. The supporting plate can be the high rigid plate or, alternatively, the supporting plate can be made of a resilient material such as a leaf spring and serves as the pressurizing means.

When pressure is applied to the platen roller from the side of the supporting plate (from the side opposed to the thermal head), the platen roller contacts closer to the line thermal head by segmenting or dividing the supporting plate along its longitudinal direction at a proper pitch. Particularly, the contacting of the platen roller and the thermal head is increased by combining the segmented supporting plate, the flexible platen roller and the flexible supporting rollers, and it becomes possible to provide the printer assembly and the printer for performing more excellent quality printing.

Undulation comprising alternate projections and recesses or lands and grooves may be formed on the supporting plate along the longitudinal direction of the supporting rollers for reducing frictional force between the supporting rollers and the supporting plate.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

Figure 1:
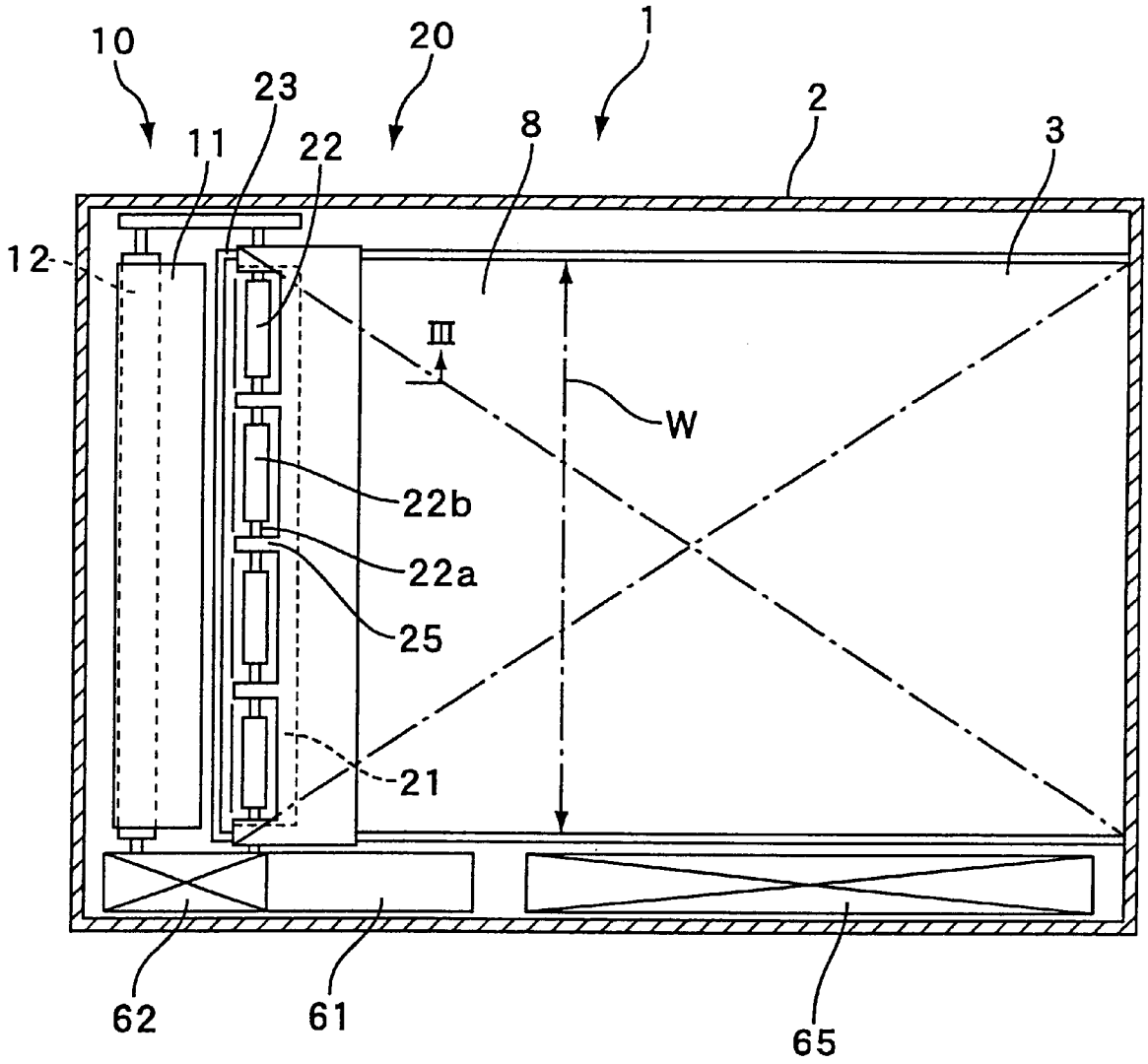
FIG. 1 is a plan view showing an arrangement of a printer according to the present invention.

An embodiment of the present invention will be explained below with reference to the drawings. FIG. 1 shows a structure of a printer 1 according to the present invention in plan. The printer 1 of the embodiment is formed in a rectangular shape with the entire size corresponding to A7 size (74 mm×105 mm), and it is a portable type printer which is accommodated in a housing 2 having a thickness of approximately 5 mm and is entirely formed in such a shape as a thin card. A space 3 for accommodating thermosensible type cut sheets (a cut paper or a thermal sheet) of A 8 size (52 mm×74 mm) is provided within the housing 2. Cut sheets are fed one by one from the accommodating space 3 to a printer assembly 10 by a feeding mechanism 20, and the printed sheets or papers are output or ejected from an ejecting opening 4 provided at a side opposed to the space 3.

Figure 2:
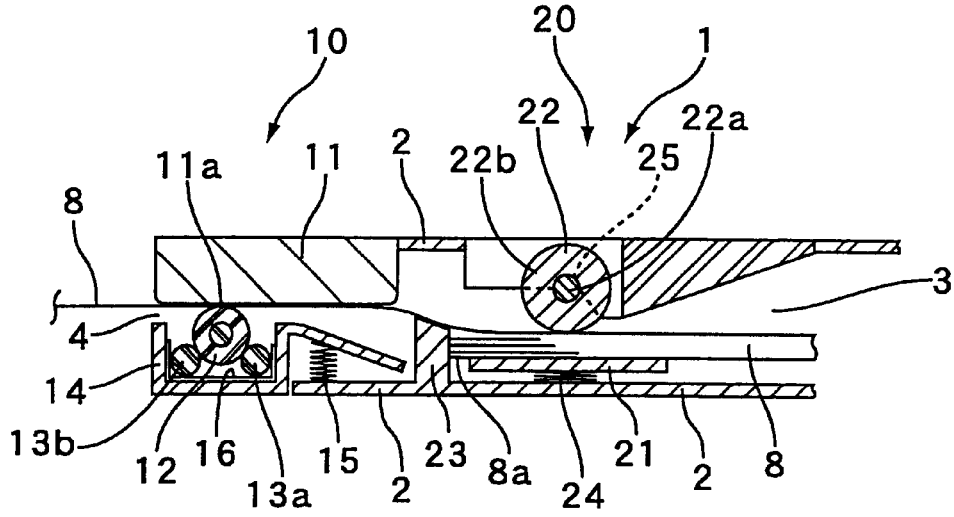
FIG. 2 is an enlarged view showing a structure of a printer assembly of the printer shown in FIG. 1.

As shown in FIG. 2 in an enlarged manner, the paper feeding mechanism 20 is provided with a bottom plate or pushing-up plate 21 disposed so as to push up a leading portions of the cut sheets 8, a pick-up roller 22 disposed so as to hold the cut sheets 8 in cooperation with the pushing-up plate 21, and a separating wall (separating portion) 23 at which the tip end 8*a* of the cut sheet 8 are stopped and separated only the uppermost cut sheet 8 from the others, only the uppermost cut sheet 8 is fed to the printer assembly 10. Also, a spring 24 for driving the pushing-up plate 21 is disposed between the pushing-up plate 21 and the housing 2.

The printer assembly 10 that prints on the fed thermal sheet 8 is provided with a line thermal head (hereinafter, referred to as "thermal head" or "head") 11 extending in a paper width direction W over the entire paper width, a platen roller 12 for holding the thermal sheet 8 between the thermal head 11 and the platen roller to press a thermosensible surface of the thermal sheet 8 on to the thermal head 11, two supporting rollers 13*a* and 13*b* for supporting the platen roller 12 from a side opposed to the thermal head 11, and a supporting plate 14 for bearing the supporting rollers 13*a* and 13*b*. The supporting plate 14 is pushed up relative to the housing 2 in a direction of the thermal head 11 by a spring 15, so that the platen roller 12 is pushed towards a printing face 11*a* of the thermal head 11. As a result, the thermosensible sheet 8 is pressed or pushed to the thermal head 11 with sufficient pressure by the platen roller 12 and it is printed and ejected from the ejecting opening 4.

As further shown in FIG. 1, in the housing 2 of the printer 1 of this embodiment, a motor 61 for driving the pick-up roller 22 and the platen roller 12, and a transmission mechanism 62 are accommodated. A space 65 for a battery, which is a power source for the motor 61 is also provided in the housing 2. Also, the printer 1 of this embodiment is provided with all other functions (not shown) required for working as a printer, such as an interface for communicating with a host terminal as a personal computer, a PDA, portable phone or the like to receive data for printing, a control function for controlling the motor 61 according to the data. Accordingly, the printer 1 is carried together with the portable terminal such as PDA and desired data can be printed out easily whenever required. Alternatively, when the printer 1 is integrated or attached to the portable telephone or it is accommodated in a device bay of a notebook type personal computer, it is possible to carry the printer 1 as a part of the portable telephone or the computer.

In the printer of this embodiment, several mechanisms are employed for realizing thin printer 1. First, the pick-up roller 22 of the paper feeding mechanism 20 includes a plurality of rotating bodies 22*b* with a diameter of about 2 mm connected in series by a shaft 22*a* with a diameter of about 1 mm in the paper width direction. The shaft 22*a* is supported at its portions between adjacent rotating bodies 22*b* by bearings 25 extending from the housing 2. Therefore, the shaft 22*a* is supported from the housing 2 at the several points distributing along the length direction, even when the diameter of the pick-up roller is small, the roller is prevented from flexing so as to securely pick up a printing paper 8.

In general, for preventing flexure of a roller, a method is employed that the roller is increased in diameter and the strength thereof is increased. It is necessary to make the diameter of the roller about 10 mm or more in order to increase the strength. However, it is possible to provide a mechanism for supporting a shaft within the range of the thickness of a roller so as to flexure of the shaft being prevented by dividing a roller body (rotating body) into a plurality of portions for supporting intermediate portions of the shaft positioned between adjacent divided portions by bearings (shaft support). This mechanism is applied to the pick-up roller 22 and the roller itself or the roller alone is not required to have strength for receiving the entire pressure. The diameter of the pick-up roller can be made to about 10 mm or less, preferably about 5 mm or less, in this case 2 mm, and the roller can be prevented from flexing.

However, this supporting method cannot be applied to the platen roller 12 because the platen roller shall not be divided along its longitudinal direction. If the platen roller 12 does not press a printing paper on the thermal head 11 over the entire length of the thermal head 11, non-pressurized or less pressurized portions are not printed or are poor printed. For solving such a drawback, in the printer assembly 10 of the embodiment, the platen roller 12 is supported by the two supporting rollers 13*a* and 13*b*.

Figure 3:
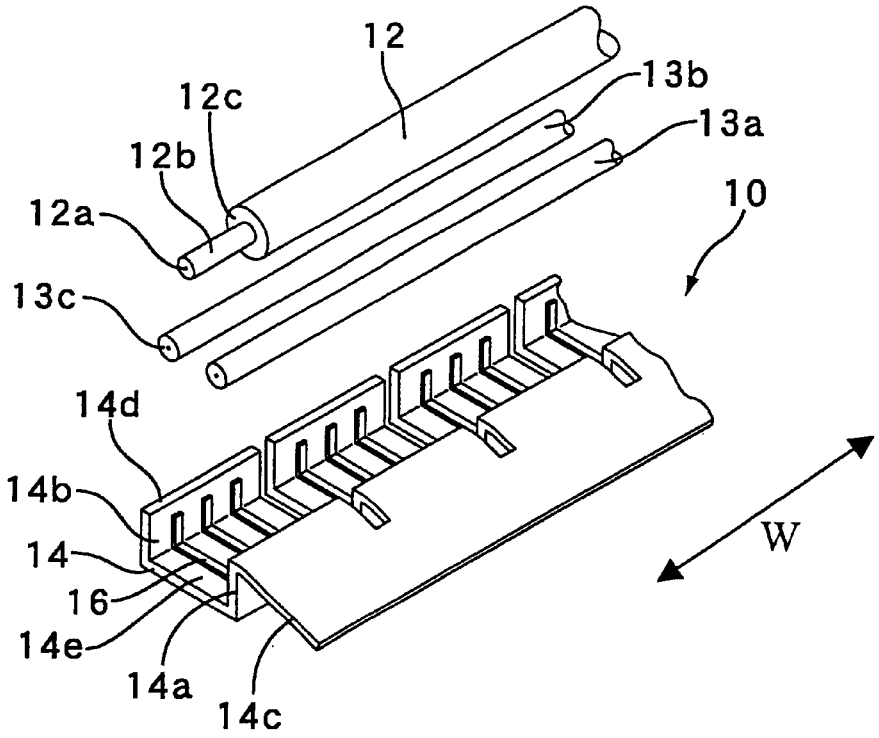
FIG. 3 is an exploded perspective view showing main components of the printer assembly of the printer shown in FIG. 1.
Figure 4:
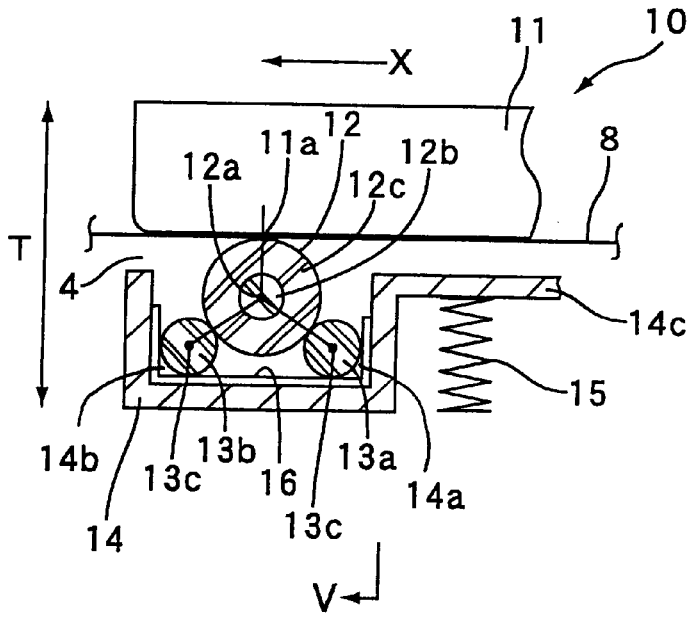
FIG. 4 is an enlarged sectional view showing a portion of the printer assembly.
Figure 5:
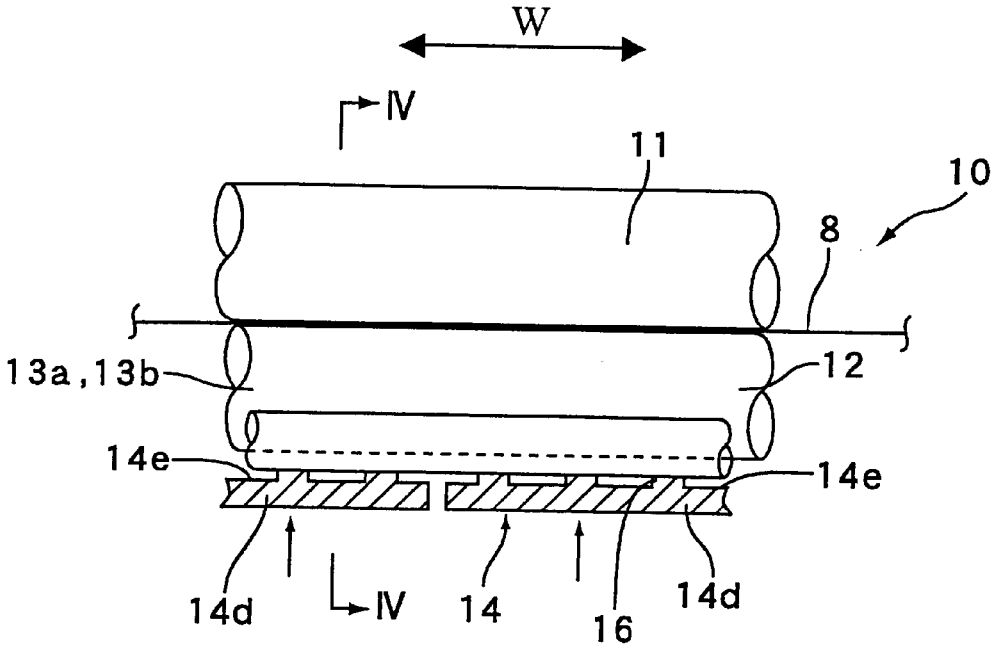
FIG. 5 is an enlarged side view showing a portion of the printer assembly.

FIG. 3 shows members constituting the printer assembly 10 in an exploded manner, and FIG. 4 shows a schematic structure of the printer assembly 10 in a cross-sectional manner. Also, FIG. 5 shows an aspect of the schematic structure of the printer assembly 10 viewed from a side direction to the longitudinal direction of the printer assembly 10. The two supporting rollers 13*a* and 13*b* are disposed at front and rear of the platen roller 12 in a paper feeding direction X of the platen roller 12. For this reason, a line connecting the center 12*a* of the platen roller 12 and each center 13*c* of the supporting rollers 13*a* and 13*b* is inclined to a thickness direction T connecting the center 12*a* of the platen roller 12 and the printing surface 11*a* of the thermal head 11 so that the structure where the platen roller 12 and the respective supporting rollers 13*a* and 13*b* are stacked is accommodated in a space of a size smaller than that defined by the sum of the respective diameters of these rollers 12, 13*a* and 13*b*.

The platen roller 12 of this embodiment is a roller with a diameter of 2 mm including a resin or metal shaft 12*b* with a diameter of 1 mm and a silicon rubber coating layer 12*c* applied on the shaft 12*b*. Each of the supporting rollers 13*a* and 13*b* is a rod-shaped roller or a shaft with a diameter of 1 mm made of fluorine resin. Accordingly, the platen roller 12 and the supporting rollers 13*a* and 13*b* are arranged in a space of 3 mm or less, for example, about 2.5 mm, in a thickness direction in this printer assembly 10.

The supporting plate 14 supporting and bearing the supporting rollers 13*a* and 13*b* from the side opposed to the thermal head 11 is formed in a U-shape opened to the thermal head 11. The supporting rollers 13*a* and 13*b* are respectively accommodated in front and rear corners 14*a* and 14*b* of the supporting plate 14. Therefore, when the platen roller 12 is rotated, the two supporting rollers 13*a* and 13*b* are rotated according to the rotation of the platen roller 12 at the corners 14*a* and 14*b*, but the centers 13*c* thereof are not moved forward and backward. Accordingly, the platen roller 12 supported at its front and rear portions by the supporting rollers 13*a* and 13*b* is not moved forward and backward within the supporting plate 14 and it is rotated at a predetermined position.

Furthermore, the supporting plate 14 is provided with an arm portion 14*c* extending toward the paper feeding direction, and the arm portion 14*c* is biased upward, namely in a direction of the thermal head 11, by the pressurizing means that is springs 15 in this embodiment. Therefore, the supporting rollers 13*a* and 13*b* are moved or pressed toward the thermal head 11 by the bearing plate 14. As a result, the platen roller 12 is pressed toward the thermal head 11. As shown in FIG. 3, the supporting plate 14 is segmented or divided to several portions 14*d* along the longitudinal direction of the platen roller 12 that is the same direction of paper width direction W. The springs 15 are arranged corresponding to the segmented portions 14*d*. In this printer assembly 10, the flexible system comprising of the flexible platen roller 12 and the flexible supporting rollers 13*a* and 13*b* is supported by the segmented portions 14*d* of the supporting plate 14, therefore, the platen roller 12 is flexibly pressed to the thermal head 11 via the supporting rollers 13*a* and 13*b* by the segmented portions 14*d* of the bearing plate 14. As a result, the shape of the platen roller 12 is changed so as to conform to the shape of the thermal head 11 along the thermal head 11 and it comes in close contact with the thermal head 11. For example, even when the thermal head 11 is slightly flexed or it is inclined, the platen roller 12 can be deformed so as to conform to the shape of the thermal head 11 to be pressed on the thermal head 11. Accordingly, it is possible to bring a printing paper 8 into close contact with the thermal head 11, and an excellent quality and clear print without blur and other degrading can be obtained.

In a conventional printer, for pressing a printing paper on a thermal head without unevenness, a platen roller is increased in rigidity so as not to flex. For this reason, a metal roller with a high rigidity having a certain diameter, for example a diameter of 10 mm or more, is employed. In this embodiment, however, for the purpose of providing a very thin printer, the diameter of the platen roller 12 is made small. In the case of such a small diameter, it is impossible to secure the required rigidity system for the platen roller. Therefore, in this embodiment, a flexible roller system that is different from the conventional rigidity platen roller is employed as the platen roller 12. Therefore, in this printer assembly 10, the flexible platen roller 12 is pressed by the supporting plate 14 segmented appropriately along the longitudinal directions of the platen roller 12 via the flexible supporting rollers 13*a* and 13*b* so that a printing paper 8 is brought in close contact with the thermal head 11 by these flexible rollers.

It is also possible to say that in the printer 1 of this embodiment, since the flexible platen roller 12, which is quite different from a conventional technique where a platen roller is increased in rigidity in order to press a printing paper on to a thermal head without unevenness, is employed, the diameter of the platen roller 12 is made small so that the very thin printer 1 is realized.

Furthermore, in order to realize a thin type printer, it is necessary to make the thermal head 11 itself thin, or omit a structure for reinforcing a thermal head. In this case, there occurs a possibility that the thermal head 11 cannot secure sufficient strength to be kept horizontal and the thermal head 11 may be bent or flexed in some case. In the printer 1 and printer assembly 10 of this embodiment, however, since the flexible platen roller 12 and the supporting rollers 13*a* and 13*b* are employed, the platen roller 12 and the supporting rollers 13*a* and 13*b* conform to the shape of the thermal head 11. Accordingly, even when slight deformation occurs in the thermal head 11, a printing paper can be brought in close contact with the thermal head 11 by the platen roller 12. As a result, it is possible to provide a printer which is very thin but is reliable and which can provide a high quality print.

Also, as shown in FIGS. 4 and 5, undulations 16 comprising alternate projections and recesses, or lands and grooves, are formed along the longitudinal direction of the rollers 13*a* and 13*b* on an inner surface of the plate 14*e* of the plate 14 that contacts with the supporting rollers 13*a* and 13*b*. Therefore, area of the supporting rollers 13*a* and 13*b* contacting with the plate 14 is reduced, thereby further reducing frictional force between the supporting rollers 13*a* and 13*b* and the bearing plate 14. Accordingly, since load for rotating the supporting rollers 13*a* and 13*b* is reduced, the load for rotationally driving the platen roller 12 is decreased. Therefore, the power of the motor 61 can be further reduced.

In the printer assembly (printer mechanism) 10 of this embodiment, rubber which has a high coefficient of friction and is suitable for paper feeding is used as surface material of the platen roller 12. The platen roller 12 is supported by the supporting rollers 13*a* and 13*b* with a low coefficient of friction made of fluororesin. Therefore, the high friction coefficient platen roller 12 is rotatably supported by the low friction coefficient supporting rollers 13*a* and 13*b* on the bearing plate 14. The high friction coefficient platen roller 12 rotates smoothly and securely feeds the printing sheet 8 with small loss of friction force between the roller 12 and supporting plate 14. In addition, in this embodiment, the inner surface 14*e* of the supporting plate 14 is alternate projections and recesses for decrees the friction force between the supporting rollers 13*a*, 13*b* and the supporting plate 14. Accordingly, the platen roller 12 is supported by the supporting plate 14 via the supporting rollers 13*a* and 13*b* with a little friction resistant force and the platen roller 12 can be driven more smoothly by a small driving power. Hence, in this printer 1, the motor power and size can be reduced and it makes possible to reduce the printer size itself.

It is possible to divide each of the supporting rollers 13*a* and 13*b* into pieces along its longitudinal direction (paper width direction) to expose portions of the shaft and support the roller at the exposed portions by bearings by the same system applied to the pick-up roller 22. However, in the printer assembly 10 of this embodiment, the diameter of the supporting rollers 13*a* and 13*b* are 1 mm or so, and, in fact, the roller itself forms the shaft. Accordingly, it may be hard to divide the roller 13*a* and 13*b* in view of strength and manufacturing. Furthermore, it is also difficult to dispose bearings in a space of a diameter of about 1 mm. In addition, to support the roller by the bearings, it is necessary to provide a certain space between the roller and a member for supporting the bearings such as the housing so as to prevent them from contacting each other. Furthermore, the space must be considered the some additional factors in this type of flexible system such as bent of the supporting rollers, platen rollers and the head in addition to a manufacturing tolerance of these components. Accordingly, in view of all the above circumstances, it is difficult to arrange the supporting roller within a space of 1 to 2 mm or so reasonably.

In addition, if the supporting rollers are not continuously extended along the platen roller, surface of the platen roller deforms due to discontinuous pressure from the supporting roller. Especially, the surface of the platen roller is made of high friction material such as a rubber and it is easy to deform. However, in this printer assembly 10, the platen roller 12 is supported substantially continuously along longitudinal direction via the supporting rollers 13*a* and 13*b* that extend along the platen roller 13 as shown in FIG. 3. Therefore, the platen roller 13 touches continuously, without deformation, to the line thermal head 11 so as to make uniformity print.

In the printer assembly 10 of the embodiment, since the coefficient of friction of the supporting rollers 13*a* and 13*b* is made small and the supporting rollers 13*a* and 13*b* are directly contacted with the surface of supporting plate with low friction force, the bearing system and clearances between the supporting rollers and the supporting plate are not required. As a result, it is possible to arrange the supporting rollers and the supporting plate in a space of 1 mm or so.

In a printer of this invention for printing sheet size of about A4 or more, apart from a requirement for preventing from flexing, the platen roller 12 must have a diameter of about 10 mm or more due to strength required for rotational drive. On the other hand, the supporting rollers having the same diameter as the above embodiment are sufficient in strength for supporting the platen roller 12 rotatably. Therefore, for minimizing the thickness of the printer assembly 10, the system where the supporting rollers 13*a* and 13*b* are supported by the supporting plate 14 is most preferable.

The shape of the supporting plate 14 is not limited to this embodiment. In this invention, any structure can be employed where the supporting rollers 13*a* and 13*b* can be positioned between the supporting plate 14 and the platen roller 12 such that the platen roller 12 does not contact with the supporting plate 14 directly. Any shape of the supporting plate 14 can be applied if the rotation positions of the supporting rollers 13*a* and 13*b* are fixed instead of U-shape and with or without groove and recesses. Also, the three or more supporting rollers can support the platen roller. Regarding prevention of direct contact between the platen roller and the supporting plate, it will be possible to arrange one supporting roller therebetween. However, it becomes difficult to hold the platen roller 12 stably at a predetermined position, it is preferable to arrange two or more supporting rollers at front and rear positions along the paper feeding direction in the same manner as this embodiment.

Also, the supporting plate extending continuously along its longitudinal direction (paper width direction) may press the platen roller 12 on to the thermal head 11 with a sufficient pressure, however, since the flexible platen roller and the flexible supporting rollers are employed, it is preferable to divide the supporting plate along its longitudinal direction to apply pressure on to the platen roller 12 in a dispersing manner in order that the platen roller 12 is further brought in close contact with the thermal head 11 by utilizing flexibility of these rollers.

Figure 6:
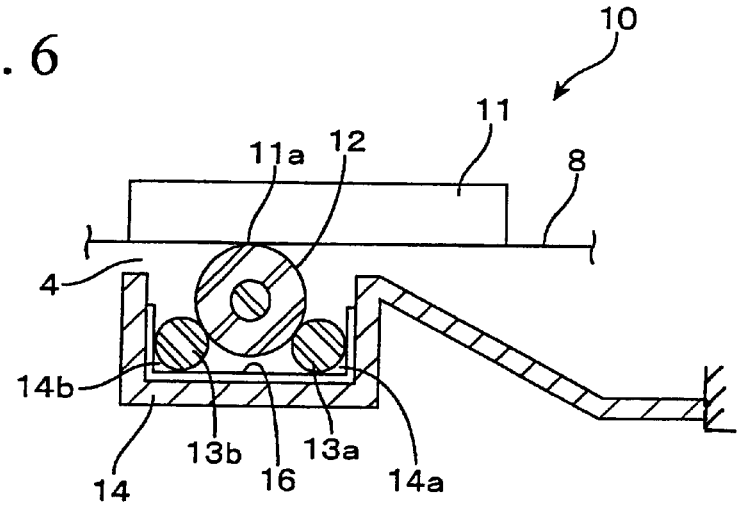
FIG. 6 is an enlarged sectional view showing a portion of a different printer assembly of a printer according to the present invention.

Further, instead of the coil springs 15 for pressurizing the corresponding segmented parts of the supporting plate 14 respectively, the other type spring such as a leaf spring, a helical spring or the like may be used and other elastic member such as a rubber can also be used. Furthermore, the supporting plate 14 may be structured such that itself has a leaf spring function as shown in FIG. 6 for applying pressure between the supporting rollers 13*a* and 13*b* and the line thermal head 11.

Pressurizing member can also be installed in the U shaped inner part of the supporting plate. A printer assembly 10 showing in FIG. 7 to FIG. 9 has a plurality of thin arch-type leaf spring 17 those are installed in a U shape inner portion 18 of a supporting plate 14 and are disposed between the supporting rollers 13*a* and 13*b* and the supporting plate 14. The U shape inner part 18 is extended along the platen roller 12 to accommodate the platen roller 12 and the supporting rollers 13*a* and 13*b* extended continuously along longitudinal direction.

Figure 7:
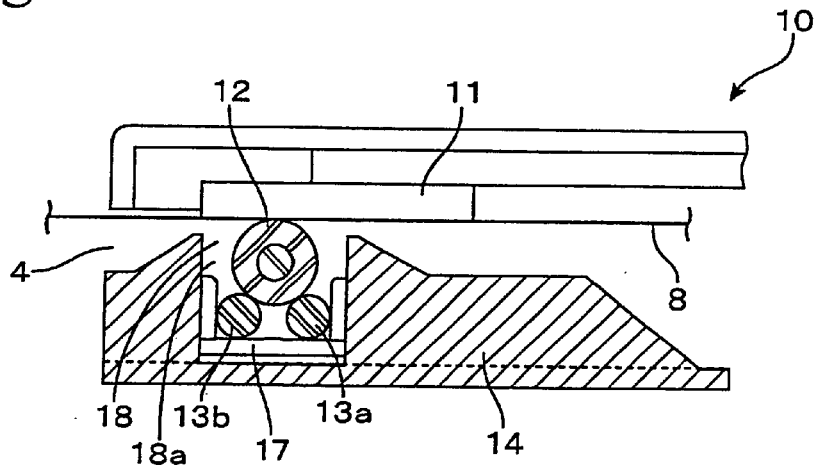
FIG. 7 is an enlarged sectional view showing a pressurizing compartment of a portion of further different printer assembly of a printer according to the present invention.
Figure 8:
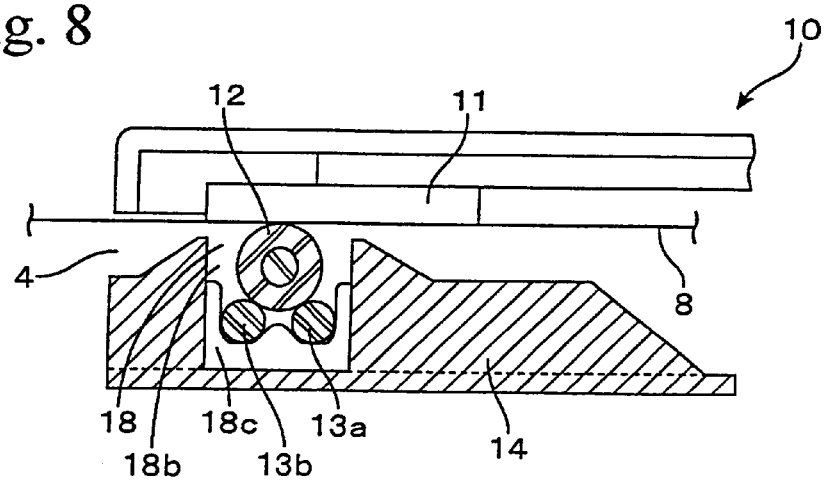
FIG. 8 is an enlarged sectional view showing a bearing compartment of a portion of the printer assembly of the printer of FIG. 7.
Figure 9:
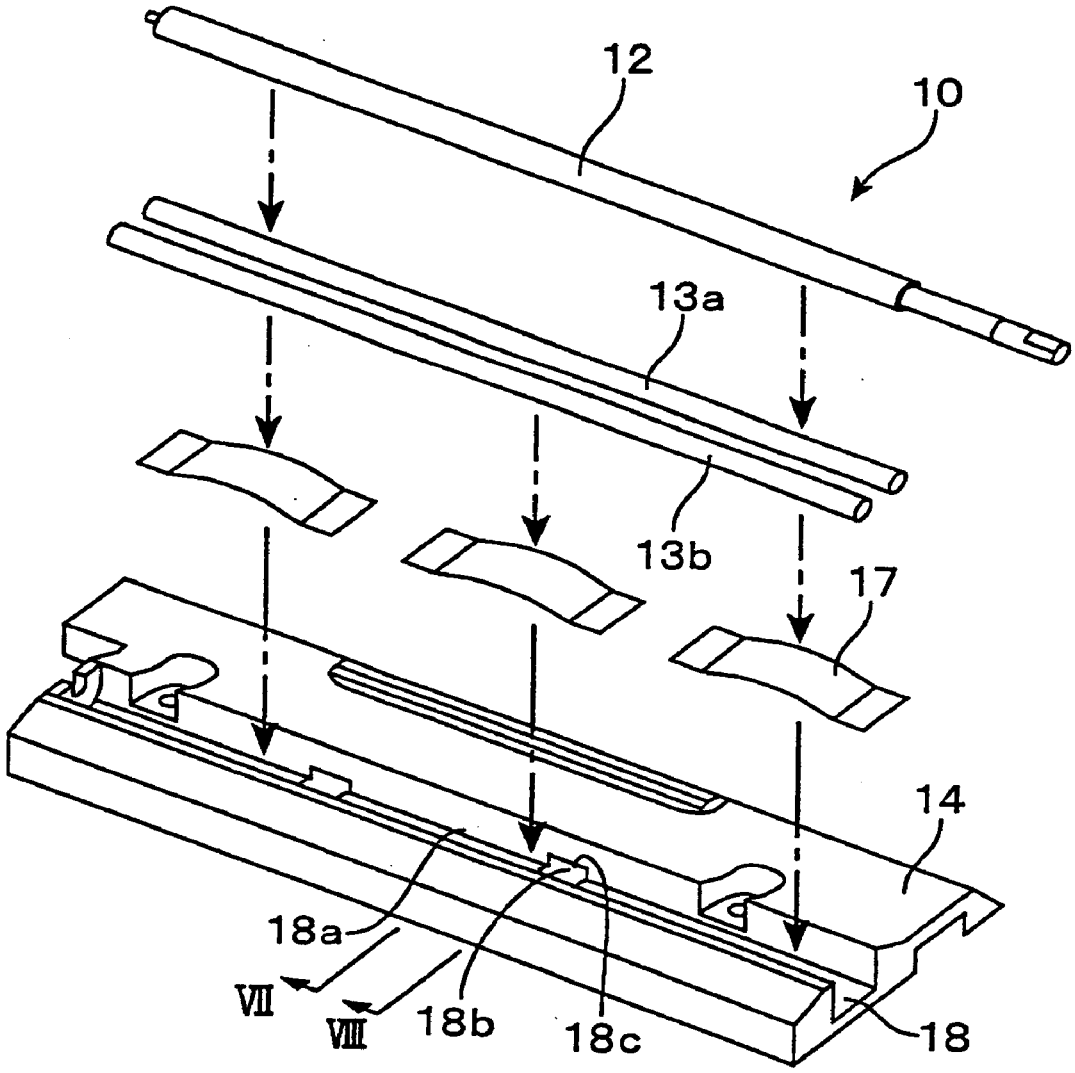
FIG. 9 is an exploded perspective view showing main components of the printer assembly of the printer shown in FIG. 7.

The U shape inner portion 18 has a two type of compartments or sections. The first type compartment 18*a* shown in FIG. 7 is a pressuring section in which the leaf spring 17 is accommodated for pressurizing the supporting rollers 13*a* and 13*b* to the line thermal head 11. The second type compartment 18*b* shown in FIG. 8 is a bearing section for rotating the supporting rollers 13*a* and 13*b* at the predetermined position front and rear of the platen roller 12. At the bearing compartment 18*b*, a shape 18*c* for fixing the rotating position of the supporting rollers 13*a* and 13*b* is made by grooves and recesses.

In this type of printer assembly 10, the supporting rollers 13*a* and 13*b* having low friction coefficient rotate smoothly by low power contacting with the leaf springs 17 and bearing shape 18*c* and pressurize the platen roller 12 continuously along it. In addition, the arch-type leaf spring is so thin to accommodate almost within the height of the bearing shape 18*c* and has enough elastic power to pressurize the platen roller 12. Therefore, thin printer assembly 10 for compact printer is provided.

In the above examples, the platen roller 12 is pressed toward the direction of the thermal head 11, but in this invention, a structure may be employed where a spring or a rubber plate is provided at a side of the thermal head 11 to apply pressure thereto. However, regarding bringing the platen roller in close contact with the thermal head by utilizing flexibility of the platen roller 12 and the supporting rollers 13*a* and 13*b*, it is preferable to apply pressure from the side of the supporting plate like this embodiment.

In this manner, the printer assembly 10 of the embodiment is a thermal printer where a space for accommodating expendables such ink is not required, and the entire structure thereof can be made very thin and compact by employing the structure of supporting the platen roller 12 by the supporting plate 14 via the supporting rollers 13*a* and 13*b*. In addition, since the platen roller system is applied, by simply driving the platen roller 12, sheet 8 are fed, printed and extracted. Therefore, the printer assembly 10 can provide the printer 1 having a very thin thickness such as a thickness of a CD case or a floppy disc case and having a simple structure and a high reliability provided at a low cost.

Also, since the printer is thin and compact but sufficient pressure is applied between the platen roller and the thermal head to press a printing paper on to the thermal head along the direction of the paper width almost uniformly, a very thin printer which has a thickness of about 5 mm, for example, and which can output a high quality print can be provided. The printer of this embodiment is purchased at a low price and be stored in any place such as a pocket, a handbag, a drawer of a desk or the like. Also, the printer is carried together with the portable terminal such as PDA, a portable telephone, and the size of the portable terminal is not increased largely even when the portable terminal is integrated or jointed with the printer. The printer of this invention can be used readily at any place and at any time.

By the printer assembly of this invention, a compact printer for printing role type print paper is also provided, however, the above printer for printing cut sheet becomes thinner than the printer for the rolled paper and cut sheet may be better for utilization of print out. Therefore, the printer of this embodiment is very convenient printer for printing at any place and at any time on demand.

The size of the card type printer of this invention is not limited for A7 size, a printer for A8 size or smaller paper is possible, furthermore, a printer for paper of A6 size or larger is also possible that becomes so thin and compact than the conventional printer.

As explained above, in the printer assembly and the printer of the present invention, the platen roller for holding a thermosensible paper in association with the line thermal head to apply pressure on the paper is supported by the supporting plate via the supporting rollers made of a small diameter member with a low coefficient of friction. In addition, the thermal type printer assembly and printer dose not require consumables such as ink and a space for accommodating the consumables, the printer of this invention becomes thin as possible and small as possible. Furthermore, even in the thin printer assembly and the printer as thin as a card, the printing sheet is pressed uniformly along its width direction to keep the quality of printing. Thus, according to the present invention, the very thin printer having a thickness of about 5 mm can be provided.

The invention may be embodied in other specific forms without departing from the spirit or essential characteristics thereof. The present embodiments are therefore to be considered in all respects as illustrative and not restrictive the scope of the invention being indicated by the appended claims rather than by the foregoing description and all changes which come within the meaning and the range of equivalency of the claims are therefore intended to be embraced therein.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A printer assembly comprising:

a line thermal head;

a platen roller having a surface of high coefficient of friction, the platen roller holding a printing paper between the platen roller and the line thermal head and feeding the printing paper;

supporting rollers having a surface of low coefficient of friction respectively, the supporting rollers being disposed at front and rear of the platen roller along a paper feeding direction for supporting the platen roller from a side opposed to the line thermal head;

a supporting plate extending along the supporting rollers for bearing the supporting rollers from the side opposed to the line thermal head; and pressurizing means for applying pressure between the supporting rollers and the line thermal head.

2. A printer assembly according to claim 1, wherein the platen roller and the supporting rollers are flexible.

3. A printer assembly according to claim 1, wherein the platen roller is a flexible shaft having the surface of rubber, and the supporting rollers are flexible shafts having the surface of low coefficient of friction.

4. A printer assembly according to claim 1, wherein the supporting rollers extend along the platen roller for supporting continuously along longitudinal direction.

5. A printer assembly according to claim 1, wherein the pressurizing means applies pressure from the side opposed to the line thermal head.

6. A printer assembly according to claim 5, wherein the pressurizing means is disposed between the supporting rollers and the supporting plate.

7. A printer assembly according to claim 6, wherein the pressurizing means is arch type leaf spring.

8. A printer assembly according to claim 5, wherein the pressurizing means applies pressure to the supporting plate.

9. A printer assembly according to claim 8, wherein the supporting plate has a high rigidity.

10. A printer assembly according to claim 9, wherein the supporting plate is segmented along the longitudinal direction of the supporting rollers.

11. A printer assembly according to claim 1, wherein the supporting plate is a leaf spring and serves as the pressurizing means.

12. A printer assembly according to claim 11, wherein the supporting plate is segmented along the longitudinal direction of the supporting rollers.

13. A printer assembly according to claim 1, wherein each of the supporting rollers rotates at predetermined position.

14. A printer assembly according to claim 1, wherein the supporting plate has a U shape inner portion and the supporting rollers are respectively accommodated in front and rear corners of the U shape inner portion.

15. A printer assembly according to claim 1, wherein the supporting plate has grooves and/or recesses for fixing rotating positions of the supporting rollers.

16. A printer assembly according to claim 1, wherein the supporting plate has undulations along the longitudinal direction of the supporting rollers.

17. A printer assembly according to claim 1, wherein the supporting plate has projections and/or recesses for decreasing friction force between the supporting rollers and the supporting plate.

18. A printer comprising the printer assembly according to claim 1 and a paper feeding mechanism for feeding a thermosensible paper to the printer assembly.

* * * * *